US010634156B2

(12) United States Patent
Hermes

(10) Patent No.: US 10,634,156 B2
(45) Date of Patent: Apr. 28, 2020

(54) CENTRIFUGAL COMPRESSOR

(71) Applicant: Siemens Aktiengesellschaft, Munich (DE)

(72) Inventor: Viktor Hermes, Duisburg (DE)

(73) Assignee: Siemens Aktiengesellschaft, Munich (DE)

( * ) Notice: Subject to any disclaimer, the term of this patent is extended or adjusted under 35 U.S.C. 154(b) by 235 days.

(21) Appl. No.: 15/517,347

(22) PCT Filed: Oct. 5, 2015

(86) PCT No.: PCT/EP2015/072915
§ 371 (c)(1),
(2) Date: Apr. 6, 2017

(87) PCT Pub. No.: WO2016/062531
PCT Pub. Date: Apr. 28, 2016

(65) Prior Publication Data

US 2017/0306972 A1 Oct. 26, 2017

(30) Foreign Application Priority Data

Oct. 21, 2014 (DE) ..... 10 2014 221 362

(51) Int. Cl.
*F04D 29/24* (2006.01)
*F01D 5/14* (2006.01)
(Continued)

(52) U.S. Cl.
CPC ..... *F04D 29/242* (2013.01); *F01D 5/141* (2013.01); *F01D 9/041* (2013.01); *F01D 17/165* (2013.01);
(Continued)

(58) Field of Classification Search
CPC ..... F02D 29/242; F02D 29/30; F02D 29/287; F02D 29/284; F02D 29/444; F01D 5/141;
(Continued)

(56) References Cited

U.S. PATENT DOCUMENTS 6,457,938 B1 * 10/2002 Liu ..... F01D 5/141 415/148
7,255,530 B2 * 8/2007 Vogiatzis ..... F01D 5/141 415/159
(Continued)

FOREIGN PATENT DOCUMENTS

DE 102010014556 B4 1/2013
DE 102012216656 B3 8/2013
(Continued)

OTHER PUBLICATIONS

DE Search Report dated Jan. 18, 2016, for DE patent application No. 102014221362.2.
(Continued)

*Primary Examiner* — George C Jin
(74) *Attorney, Agent, or Firm* — Beusse Wolter Sanks & Maire

(57) ABSTRACT

A centrifugal compressor having a stator which is designed as an inlet stator, in particular for a compressor, with at least one vane having a vane airfoil around which a fluid can flow, with a plurality of vanes arranged in the form of a ring, with an adjustment device for adjusting the vane, wherein a curvature of a profile center line of the vane airfoil has at least one inflection point.

8 Claims, 2 Drawing Sheets

(51) Int. Cl.

| | |
|---|---|
| ***F01D 17/16*** | (2006.01) |
| ***F04D 29/46*** | (2006.01) |
| ***F01D 9/04*** | (2006.01) |
| ***F04D 29/28*** | (2006.01) |
| ***F04D 29/30*** | (2006.01) |

(52) U.S. Cl.
CPC ..... *F04D 29/284* (2013.01); *F04D 29/287* (2013.01); *F04D 29/30* (2013.01); *F04D 29/462* (2013.01); *F05D 2220/40* (2013.01); *F05D 2250/51* (2013.01); *F05D 2250/70* (2013.01)

(58) Field of Classification Search
CPC . F01D 5/142; F01D 9/041; F01D 9/02; F01D 9/045; F01D 17/165; F01D 17/12; F01D 17/167; F01D 17/14; F01D 17/16; F05D 2220/40; F05D 2250/611; F05D 2250/70; F05D 2250/713; F02B 37/24; F04D 29/242; F04D 29/30; F04D 29/287; F04D 29/284; F04D 29/444
See application file for complete search history.

(56) References Cited

U.S. PATENT DOCUMENTS

| | | | | |
|---|---|---|---|---|
| 8,613,592 | B2 | 12/2013 | Elorza Gomez | |
| 8,641,382 | B2 | 2/2014 | Weber | |
| 9,528,386 | B2 * | 12/2016 | Morita | F01D 5/141 |
| 2011/0314808 | A1 * | 12/2011 | Mohamed | F01D 5/141 60/602 |
| 2014/0205458 | A1 * | 7/2014 | Japikse | F01D 9/041 416/179 |
| 2016/0053774 | A1 | 2/2016 | Tarnowski et al. | |
| 2016/0312651 | A1 * | 10/2016 | Boening | F01D 5/048 |

FOREIGN PATENT DOCUMENTS

| | | | |
|---|---|---|---|
| EP | 1790830 | A1 | 5/2007 |
| EP | 2241722 | A1 | 10/2010 |
| RU | 2470159 | C1 | 12/2012 |
| WO | 2005059313 | A2 | 6/2005 |
| WO | 2009086959 | A1 | 7/2009 |
| WO | 2014044446 | A1 | 3/2014 |
| WO | 2014154997 | A1 | 10/2014 |

OTHER PUBLICATIONS

International Search Report dated Dec. 18, 2015, for PCT/EP2015/072915.
IPPR (PCT/IPEA/4016 and 409) dated Feb. 28, 2017, for PCT/EP2015/072915.
Verdichter; aus Wikipedia, der freien Enzyklopädie, http://de.wikipedia.org/wiki/Verdichter Aug. 10, 2014 / "Radialverdichter"; 2014; English translation dated Mar. 17, 2017, entitled Gas Compressor, attached, https://en.wikipedia.org/wiki/Gas_compressor.
Siemens-Internetseite, Getriebeturboverdichter, STC-GC-Siemens; http://www.energy.siemens.com/hq/de/verdichtung-expansion-ventilation/turboverdichter/getriebeturboverdichter/stc-gc.htm; 2014; English translation entitled Standardized Turbocompressors, STC-GC, dated Mar. 19, 2017 attached, http://www.energy.siemens.com/hq/en/compression-expansion/product-lines/standardized-compressors/stc-gc.htm.
"Profil (Strömungslehre)"—aus Wikipedia, der freien Enzyklopädie, http://de.wikipedia.org/wiki/Profil_(Strömungslehre) (Stand Sep. 7, 2014); 2014, English translation dated Mar. 17, 2017, entitled Airfoil, attached, https://en.wikipedia.org/wiki/Airfoil.
"Einstufige Verdichter"—Turboverdichter—Einstufiger Verdichter—STC-GO-Siemens: http://www.energy.siemens.com/hq/de/verdichtung-expansion-ventilation/turboverdichter/einstufige-verdichter/stc-go.htm (Stand: Oct. 6, 2014); 2014, English translation dated Mar. 19, 2017, attached, entitled Single Stage Turbocompressors, STC-GO-Siemens: http://www.energy.siemens.com/hq/en/compression-expansion/product-lines/single-stage/stc-go.htm.
RU search report dated May 11, 2018, for RU patent application No. 2017117286/06.

* cited by examiner

CENTRIFUGAL COMPRESSOR

CROSS REFERENCE TO RELATED APPLICATIONS

This application is the US National Stage of International Application No. PCT/EP2015/072915 filed Oct. 5, 2015, and claims the benefit thereof. The International Application claims the benefit of German Application No. DE 102014221362.2 filed Oct. 21, 2014. All of the applications are incorporated by reference herein in their entirety.

FIELD OF INVENTION

The invention relates to a centrifugal compressor having a stator.

BACKGROUND OF INVENTION

Compressors or fluid-compressing devices are used in various fields of industry for various applications involving compression of (process) fluids, especially (process) gases. Known examples of this are turbocompressors in mobile industrial applications such as exhaust-gas turbochargers or jet engines, but also in static industrial applications such as geared turbocompressors for air fractionation.

In the case of such a continuous-operation turbocompressor, the increase in pressure (compression) of the fluid is brought about by a rotary impulse of the fluid from inlet to outlet being increased by a rotating impeller, having radially-extending vanes, of the turbocompressor, by the rotation of the vanes. Here, that is to say in such a compressor stage, the pressure and temperature of the fluid rise while the relative (flow) velocity of the fluid in the impeller drops. In order to achieve maximum pressure increase or compression of the fluid, multiple such compressor stages can be connected in series.

Turbocompressor architectures are divided between centrifugal and axial compressors.

In an axial compressor, the fluid that is to be compressed, for example a process gas, flows through the compressor in a direction parallel to the shaft (axial direction). In a centrifugal compressor, the gas flows axially into the impeller of the compressor stage and is then deflected outward (radially, in the radial direction). Thus, in the case of multi-stage centrifugal compressors, a flow redirection is required downstream of each stage.

A centrifugal compressor of this type is known from http://de.wikipedia.org/wiki/Verdichter (retrieved Oct. 6, 2014).

Combined architectures of axial and centrifugal compressors use their axial stages to draw in large volumetric flows which are compressed to high pressures in the subsequent centrifugal stages.

While single-shaft machines are usually used, in geared compressors the individual compressor stages are grouped around a bull gear, with multiple parallel shafts—which each bear one or two impellers that are accommodated in volute casings—being driven by a large driving gearwheel, a bull gear.

A geared compressor of this type, a geared turbocompressor produced by Siemens under the reference STC-GC, and used for air fractionation, is known from http://www.energy.siemens.comfhq/de/verdichtung-expansion-ventilation/turboverdichter/getriebeturboverdichter/stc-gc.htm (retrieved Oct. 6, 2014).

Another compressor, in this case a single-stage geared centrifugal compressor with open-form, overhung impeller, a geared turbocompressor produced by Siemens under the reference STC-GO, and used to satisfy the requirements of the metallurgic, fossil and chemical industries, is known from http://www.energy.siemens.com/hq/de/verdichtung-expansion-ventilation/turboverdichter/einstufige-verdichter/stc-go.htm (retrieved Oct. 6, 2014).

In times of increasingly flexible processes, requirements in terms of (closed-loop/open-loop control) flexibility and/or in terms of power generally also increase, especially for turbomachines.

To that end, and in order to improve/increase an efficiency and/or control range of the turbomachines, to influence characteristic diagrams of the turbomachines, or indeed in order to control turbomachines at all, it is known to provide such turbomachines with stators such as generally adjustable inlet stators connected upstream of an axial-flow impeller and/or outlet stators connected downstream of an axial-flow impeller.

Stators of this kind have vanes that are generally arranged in a ring shape and may be (angularly) adjustable by means of an (adjustment) mechanism, and that have profiled vane airfoils around which the (process) fluid flows/can flow and which contribute to optimized guiding of the flow through the turbomachine.

An inlet and outlet stator of this type is known for example from DE 10 2012 216 656 A1. The geared turbocompressor STC-GC also has an inlet stator (upstream of its first stage).

An axial compressor having a guide vane of a stator is known from EP 2 241 722 A1, wherein the guide vane has an inflection point in the profile center line or camber line. WO 2005/059313 A2, WO 2009/086959 A1 and EP 1790 830 A1 each show a turbocharger having corresponding guide vanes at the turbine.

For example—in the case of an adjustable inlet stator—such an adjustable inlet stator is thus used to adapt and/or regulate the (process) fluid entering the turbomachine axially (with respect to the impeller axis), or the flow of this fluid with respect to velocity and flow direction before it is incident on the impeller or on the first impeller stage in dependence on a power requirement for the turbomachine, by (angular) adjustment of the vane airfoils or of the vanes of the vane ring of the inlet stator.

However, in particular in the case of large angular adjustments of the vane airfoils or vanes, the fluid flow no longer follows a profile contour of the vanes or vane airfoils, which is associated with flow losses, reduced efficiency and thus also limits on the (power or flexibility) requirements of the turbomachines.

This is also the case for outlet stators of turbomachines, or angular adjustments there.

SUMMARY OF INVENTION

The invention is based on the object of improving drawbacks of the prior art and producing, simply and cost-effectively, turbomachines which can be operated flexibly with high efficiency.

The object is achieved with a stator for a turbomachine, in particular for a compressor, and with a turbomachine with such a stator having the features as claimed in the respective independent claim.

The stator has at least one vane having a vane airfoil around which a fluid can flow. In that context, a curvature of a profile center line (also termed camber line) of the vane airfoil has at least one inflection point.

In that context, the profile can be understood—in accordance with the fluid dynamics definition (cf. http://de.wikipedia.org/wiki/Profil (Stromungslehre), retrieved Oct. 6, 2014)—as being the cross-sectional shape of a body, here of the vane airfoil, in the flow direction. The profile center line or camber line (also the line of curvature) can be understood as being the line connecting the center points of circles inscribed within a profile, in this case the vane airfoil profile.

By modifying the profile center line, that is to say by means of the curvature, having at least one inflection point (or possibly also multiple points of inflection), of the profile center line of the vane airfoil, briefly and simply—by means of the curved profile center line, having at least one inflection point (or possibly also multiple points of inflection), of the vane airfoil, it is possible for a vane airfoil profile surface to be changed such that it is possible to reduce flow losses in a—far—adjustment region of an (adjustable) vane of an adjustable stator, without significant change in a 0° position of the vane airfoil or vane.

This makes it possible to improve the power or power data of a turbomachine at certain operating points such as a main guarantee point.

Refinements of the invention also derive from the dependent claims.

One refinement provides that the curvature of the profile center line/camber line of the vane airfoil has exactly one inflection point. Put simply and clearly, in this case the vane airfoil forms a profile similar to a reflexed camber profile (for lifting surfaces, for example in the case of flying wings, winglets). The name "reflexed camber" originates from the fact that the profile center line/camber line turns back upward in an "S" shape in the rear portion of the profile, and as a result—here in the case of the vane airfoil—the flow leaves the vane airfoil with swirl (which is dependent on a shape of the "S-shaped course" or on a profile trailing edge pointing upward in an "S" shape).

Alternatively, it can furthermore be provided that the curvature of the profile center line of the vane airfoil has two ("double-reflexed"), three ("triple-reflexed") or even more points of inflection.

According to another refinement, it is provided that a number of points of inflection and/or a position of the at least one inflection point—or, in the case of multiple points of inflection, the positions of the points of inflection—and/or also a magnitude and/or a course of the curvature, briefly and simply a shape of the curvature, is dependent on an aerodynamic specification, in particular on incident flow conditions of the vane airfoil and/or of the impeller that are to be determined. It is also possible for other profile sizes and/or geometries, such as profile thickness, profile depth and/or span of the vane airfoil, to be accordingly configured in dependence on the aerodynamic specification.

In that context, the position (of the inflection point) can be understood, and is thus labeled in the following, as that point (measured back from the leading edge of the vane airfoil) on the chord of the airfoil that corresponds to a projection of the at least one inflection point or of the inflection point onto the chord. A relative inflection point position is the inflection point position relative to the length of the chord, or in other words the profile depth.

Thus, in clear and simple terms, it is for example possible, for an operating or design point of a fluid machine for which the stator is intended, for example as its inlet stator, for the angle of attack of this stator to be fixed, and then to optimize the vane airfoil profile or the shape of the curvature of the vane airfoil and thus also the number of inflection points and the inflection point position(s) of the inflection point(s), the magnitude of the curvature and/or the curvature course for the flow conditions at that location (flow incident on the vane airfoil at the angle of attack), such that, at a given angle of attack, the flow leaves the vane airfoil with a set, predetermined swirl (with respect to the impeller), but wherein the flow around the vane airfoil (at the given angle of attack) does not separate.

Another refinement provides that the vane airfoil is designed such that a profile depth of the vane airfoil changes over the span (extent of the vane airfoil from a vane airfoil root to a free vane airfoil end) of the latter. Thus, in clear and simple terms, the vane airfoil changes its profile depth between its vane airfoil root and its free vane airfoil end. For example, such a vane airfoil can be approximately trapezoidal in terms of its outer dimensions.

It can also be provided, by way of refinement, that the vane airfoil is designed such that the profile thickness (accordingly also the maximum profile thickness) changes along with the profile depth that changes over the span of the vane airfoil.

In this case, it can in particular be provided that the profile thickness changes according to the change in profile depth.

Thus, in clear and simple terms, the vane airfoil scales (over the span) in accordance with its profile depth (over the span). In this case, the relative maximum profile thickness (here, the maximum profile thickness is relative to the profile depth) and the maximum profile curvature and relative maximum profile curvature (here, the maximum profile curvature is relative to the profile depth) can remain unchanged (over the span).

In another refinement, it can also be provided that a plurality or a multiplicity of the vanes are arranged in the form of a ring. In simple terms, the vanes form a stator ring here.

Furthermore, in another refinement, it is also possible for an adjustment device to be provided for adjusting the vane or, in the case of multiple of these vanes, which are in particular arranged in a ring to form a stator ring, for an adjustment device to be provided for adjusting these vanes. To that end, it is possible to provide an (adjustment) mechanism by means of which, according to a predefined kinematic chain, it is possible to adjust one vane or all of the vanes of a stator ring. The adjustment itself can also be effected using a motor unit such as an electric motor.

It can furthermore be provided, in one refinement, that the stator is an inlet stator (and thus is or can be arranged at an inlet of the fluid machine) or an outlet stator (and thus is or can be arranged at an outlet of the fluid machine). This stator can then in particular be arranged at an inlet of the fluid machine or at an outlet of the fluid machine such that the inflow or outflow into or out of the fluid machine (via the inlet/outlet stator) is axial.

Thus, in clear and simple terms, the stator is arranged in the axial extension of an impeller shaft of the fluid machine, or a stator ring center axis is arranged in the axial extension of the impeller shaft.

In particular, the stator can be used in the context of the turbomachine, in particular in the context of a compressor such as a single- or multi-stage centrifugal compressor or a multi-staged geared compressor, or in the context of a turbine. In other words, the turbomachine, in particular a compressor or a turbine, has the stator (for example also in accordance with the refinements thereof).

The preceding description of advantageous embodiments of the invention contains a great number of features that are reproduced in the individual dependent claims, in some cases combined into groups. However, a person skilled in the art will advantageously also consider these features individually and combine them to form expedient further combinations.

The above-described properties, features and advantages of this invention and the manner in which they are achieved become more clearly and distinctly comprehensible in conjunction with the following description of one or more exemplary embodiments which is/are explained in more detail in connection with the figures.

However, the invention is not restricted to the combination of features specified in the exemplary embodiment(s), even in respect of functional features. Thus, it is additionally explicitly possible for suitable features of any one exemplary embodiment to be considered in isolation, separated from one exemplary embodiment and introduced into another exemplary embodiment to complement the latter.

In the exemplary embodiments and the figures, elements or components which are identical, or have the same function or structure, are provided with the same reference sign.

DETAILED DESCRIPTION OF INVENTION

Figure 1:
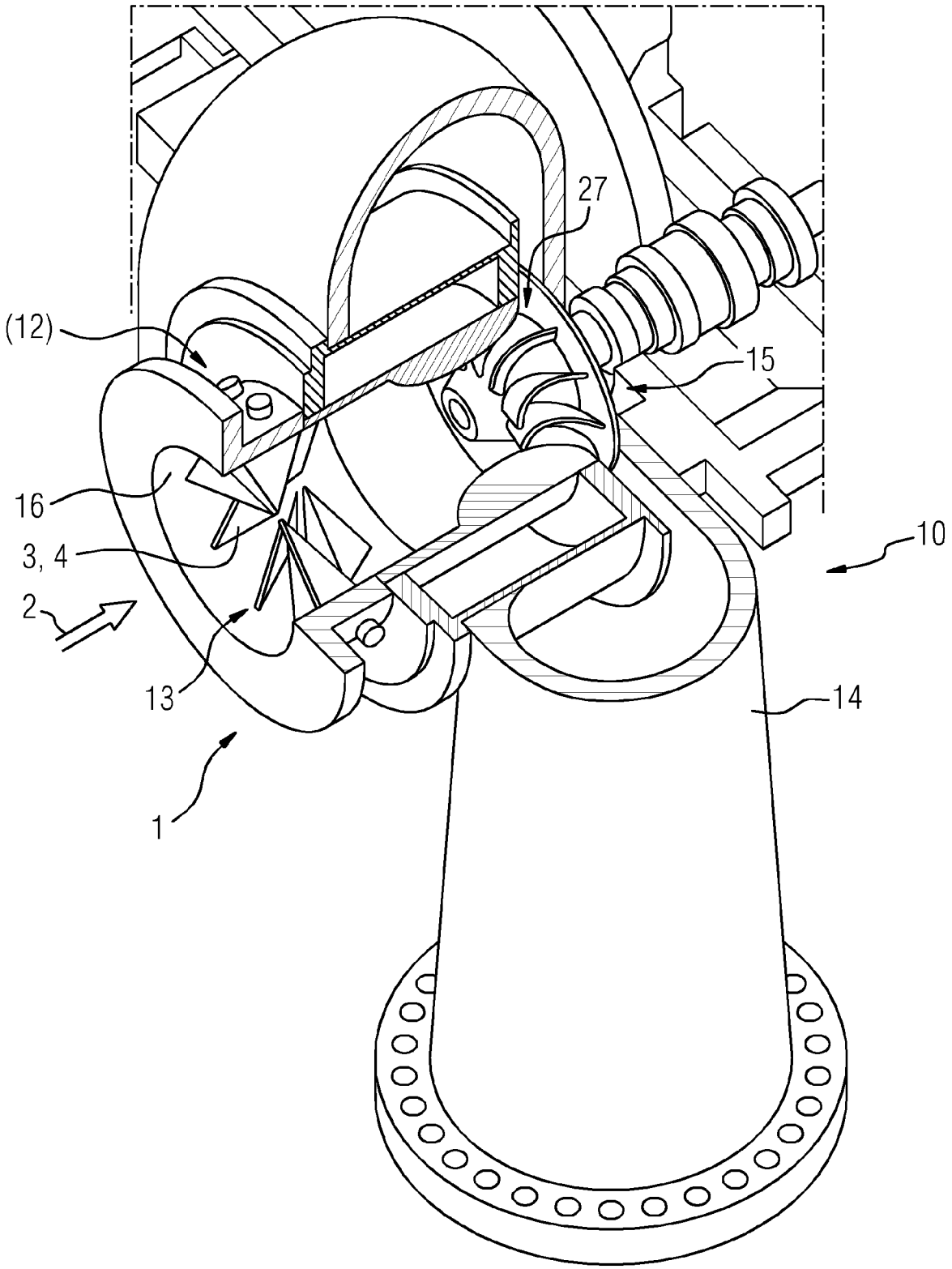
FIG. 1 is a diagram of an inlet stator for a turbomachine.

Exemplary embodiment: profiling of guide vanes of stators in turbomachinery, in particular of inlet stators for compressors FIG. 1 is a cutaway view of a multi-shaft geared compressor 10, for example for air fractionation, having a (first) compressor stage 15 arranged in a volute casing 14.

Arranged axially upstream of this (first) compressor stage 15, or of its impeller 27, at an axial inlet 16 of this volute casing 14 as shown in FIG. 1, there is an inlet stator 1 (or Inlet Guide Vane).

As also shown in FIG. 1, the inlet stator 1 has a multiplicity of guide vanes 4 (cf. FIG. 2, FIG. 3) that are arranged in a ring shape and have adjustable, profiled vane airfoils 3 (stator ring 13, inlet stator wheel 13).

The geared compressor 10 is controlled, inter alia, by means of the adjustable inlet stator 1, that is to say by adjusting the vanes 4 or their vane airfoils 3 (using an adjustment mechanism 12), which changes—depending on the angle of attack of the vanes 4 or of the vane airfoils 3 of the inlet stator wheel 13—the flow of process gas 2 onto, around and from the vane airfoils 3 of the inlet stator 1 and consequently the flow of process gas 2 into or onto the (first) compressor stage 15, or the impeller 27 thereof.

Figure 3:
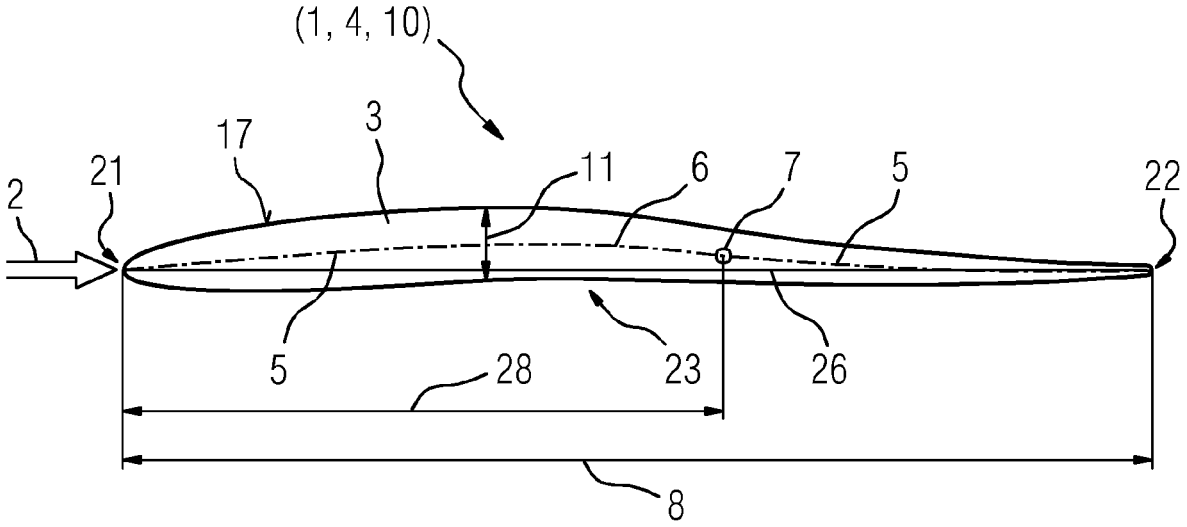
FIG. 3 is a diagram of a profile of an adjustable vane for an inlet stator (profile section III-III).

In order to avoid, even in the case of high angles of attack, for example greater than 15°, or over a large adjustment range, flow losses at the vanes 4 or vane airfoils 3 (as a consequence of a fluid flow/process gas flow that no longer follows the profile contour 17 of the vane airfoils 3, or as a consequence of the fluid flow/process gas flow separating from the vane airfoils 3), the vane airfoils 3 have, as illustrated in particular in FIG. 3, a special profile 23, i.e. in this case a reflexed camber profile 23 (with a simple "S shape").

Figure 2:
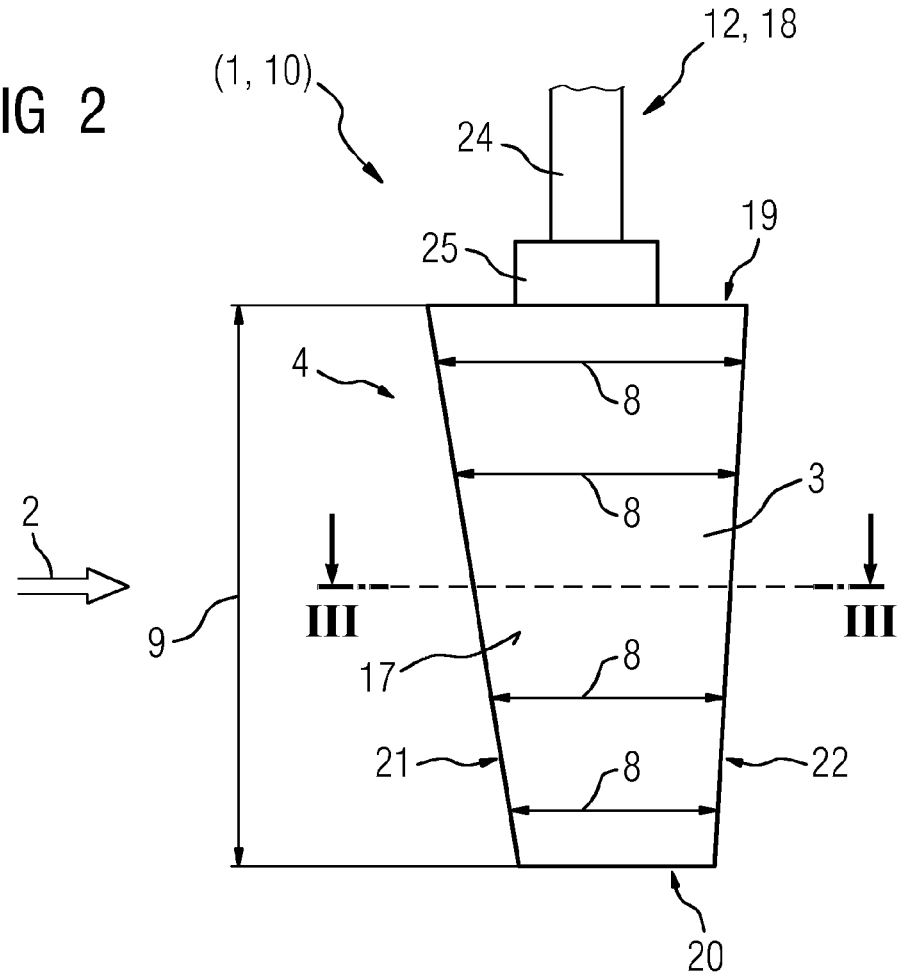
FIG. 2 is a diagram of an adjustable vane for an inlet stator.

FIG. 2 shows a/the adjustable vane 4 of the inlet stator wheel 13 of the inlet stator 1 of the geared compressor 10, this vane representing all of the (accordingly formed) vanes 4 of the inlet stator wheel 13 of the inlet stator 1.

As shown in FIG. 2, the adjustable vane 4 has the profiled vane airfoil 3, which can be (angularly) adjusted by means of the adjustment mechanism 12 which is represented here only by way of indication by a connecting shaft 18, or a peg 24 and plate 25.

As also shown in FIG. 2, the vane airfoil 3 is essentially trapezoidal in terms of its outer dimensions, that is to say that the profile depth 8 decreases continuously over the span 9 of the vane airfoil 3 (the extent of the vane airfoil 3 from its vane airfoil root 19 to its free vane airfoil end 20).

Thus, in clear and simple terms, the vane airfoil 3 changes, and in this case reduces, its profile depth 8 between its vane airfoil root 19 and its free vane airfoil end 20, that is to say over its span 9.

In accordance with this decreasing profile depth 8 (from the vane airfoil root 19 to the vane airfoil end 20, or over the span 9), the entire vane airfoil 3 scales with or in its (reflexed camber) profile 23.

That is to say that the profile thickness 11 (accordingly also the maximum profile thickness) (also) decreases over the span 9 of the vane airfoil 3, in accordance with the decreasing profile depth 8. The relative maximum profile thickness (here, the maximum profile thickness is relative to the profile depth 8) and the maximum profile curvature and relative maximum profile curvature (here, the maximum profile curvature is relative to the profile depth 8) remain unchanged over the span 9 of the vane airfoil 3.

FIG. 3 shows the (flow line) profile section, denoted by the section III-III (in FIG. 2), through the vane airfoil 3 of the vane 4 of the stator wheel 13 of the inlet stator 1, for short the profile 23 of the vane airfoil 3.

As shown in FIG. 3, the vane airfoil 3, or its profile 23, forms a reflexed camber profile 23 (with simply "reflexed camber"), with a (simply) "S-shaped" curved profile center line 6 or camber line 6.

That is to say that the ("S-shaped") curvature 5 of the profile center line/camber line 6 of the vane airfoil 3 has, in this case, exactly one inflection point 7, wherein in the forward region of the profile 23, that is to say in the region of the leading edge 21 of the vane airfoil 3, the profile center line/camber line 6 faces downward in an "S shape", and faces upward in an "S shape" in the rear region of the profile 23, that is to say in the region of the trailing edge 22 of the vane airfoil 3.

In that context, the flow around the profile 23 is also dependent on (or is in particular also influenced by) a shape of the "S-shaped course", or of the "reflexed camber" of the profile 23, that is to say, among other things, on the course and the magnitude of the curvature 5 and on the position of the inflection point 7 (in this case one but otherwise also a number of inflection points) (inflection point position 28 (the distance between the leading edge 21 of the vane airfoil 3 and the inflection point 7 as projected onto the chord 26 of the vane airfoil 3 (the chord 26 is the straight line connecting the leading edge 21 and the trailing edge 22 of the profile 23)).

The shape of the "reflexed camber" profile 23 of the vane airfoil 3 (by means of which it is possible to influence the flow conditions at the vane airfoil 3) is then dependent on the aerodynamic specification of the inlet stator 1 (optimization to the aerodynamic specification (or the operating point)), in particular of incident flow conditions of the vane airfoil 3 and/or of the impeller 27 of the (first) compressor stage 15 (at the operating point) that are to be determined.

If—as is the case here by way of example—a (design) angle of attack of the vanes 4 of the inlet stator 1 of approximately 15° is provided for the operating or design point of the compressor 10, then the "reflexed camber" profile 23, or its shape, is optimized for flow conditions there (incident flow on the vane airfoil 3 at this (design) angle of attack) such that the flow leaves the vane airfoil 3—at this assumed (design) angle of attack—with a certain, predefined swirl (with respect to the impeller 27), but wherein the flow around the vane airfoil 3 (at this assumed (design) angle of attack) does not separate or takes place with small flow losses.

As shown in FIG. 3, in this case—under known aspects—the "reflexed camber" profile 23 has only a weak "reflexed camber" (that is to say only one inflection point 7 with weak curvature 5 ("upward and downward")) with a slender profile thickness 11. The inflection point position 28 of the inflection point 7 of the "reflexed camber" or of the "reflexed camber" profile 23 of the vane airfoil 3 is slightly to the rear, i.e. in the direction of the profile trailing edge 22, of the center of the chord 26.

Although the invention has been described and illustrated in detail by way of the preferred exemplary embodiment(s), the invention is not restricted by the disclosed examples and other variations can be derived herefrom by a person skilled in the art without departing from the scope of protection of the invention.

The invention claimed is:

1. A centrifugal compressor, comprising:

a stator which is designed as an inlet stator and which comprises an inlet configured to receive an axial inlet flow of a fluid to be compressed and an outlet configured to deliver an axial outlet flow the fluid to be compressed, a plurality of vanes disposed within the stator between the inlet and the outlet and arranged in a form of a ring, wherein at least one vane of the plurality of vanes comprises a vane airfoil around which the fluid to be compressed can flow, an adjustment device for adjusting the at least one vane, wherein a curvature of a profile center line of the vane airfoil comprises at least one inflection point, wherein the vane airfoil comprises a profile depth from a leading edge to a trailing edge of the vane airfoil, wherein the vane airfoil is designed such that a profile depth at a tip of the vane airfoil is less than a profile depth at a base of the vane airfoil, and wherein the vane airfoil is designed such that a profile thickness decreases as the profile depth decreases along a span from the base to the tip of the vane airfoil.

2. The centrifugal compressor as claimed in claim 1, wherein a number of points of inflection of the at least one inflection point and/or a position of the at least one inflection point and/or a magnitude and/or a course of the curvature is/are dependent on an aerodynamic specification.

3. The centrifugal compressor as claimed in claim 1, wherein the profile thickness changes in scale with a change in profile depth such that a ratio of the profile thickness to the profile depth remains unchanged along the span from the base to the tip of the vane airfoil.

4. The centrifugal compressor as claimed in claim 1, wherein the curvature of the profile center line of the vane airfoil comprises one inflection point forming a reflexed camber profile.

5. The centrifugal compressor as claimed in claim 2, wherein the aerodynamic specification comprises incident flow conditions of the vane airfoil.

6. The centrifugal compressor as claimed in claim 1, wherein the profile depth decreases continuously from the profile depth at the base of the vane airfoil to the profile depth at the tip of the vane airfoil.

7. The centrifugal compressor as claimed in claim 1, further comprising:

an impeller configured to receive the axial outlet flow from the stator and deliver a compressed outlet flow radially outward.

8. The centrifugal compressor as claimed in claim 7, further comprising a volute casing surrounding the impeller, the volute casing comprising a flow path comprising a curved funnel shape that increases in flow area towards a radially oriented outlet of the volute casing.

* * * * *